US005628268A

United States Patent [19]

Brydel et al.

[11] Patent Number: 5,628,268

[45] Date of Patent: May 13, 1997

[54] RAPSON-SLIDE STEERING MECHANISM

[75] Inventors: Paul S. Brydel, H. H. Is, S.C.; Eugenio Millevoi, Fort Lee, N.J.

[73] Assignee: Jered Brown Brothers, Inc., Brunswick, Ga.

[21] Appl. No.: 498,689

[22] Filed: Jul. 3, 1995

[51] Int. Cl.[6] ..... B63H 25/22

[52] U.S. Cl. ..... 114/150

[58] Field of Search ..... 114/150; 440/53, 440/61, 65; 60/421, 484; 91/509, 510

[56] References Cited

U.S. PATENT DOCUMENTS

| | | | |
|---|---|---|---|
| 3,595,193 | 7/1971 | Heese | 114/150 |
| 4,143,614 | 3/1979 | Jeanson et al. | 440/61 |
| 4,209,986 | 7/1980 | Cunningham | 114/150 |
| 4,365,573 | 12/1982 | Jamieson | 114/150 |
| 4,408,555 | 10/1983 | Aung | 114/150 |

*Primary Examiner*—Stephen Avila

*Attorney, Agent, or Firm*—Oblon, Spivak, McClelland, Maier & Neustadt, P.C.

[57] ABSTRACT

A ship's steering gear mechanism (10) embodying a number of improvements to the well-known Rapson-Slide apparatus provides greatly improved operating efficiencies and cost effectiveness by inclusion of a specially configured transverse travelling channel, trunion-mounted hydraulic cylinders (12* and 14*), and reduced friction sliding/rolling slider elements (48 and 144). The traveling channels formed by a pair of transverse beams (34) prevent harmful forces from being reflected back into the hydraulic cylinders, thus reducing their size and strength requirements, while other improvements decrease operating losses due to friction/stiction, and compensate for both static and dynamic component misalignments.

23 Claims, 3 Drawing Sheets

RAPSON-SLIDE STEERING MECHANISM

TECHNICAL FIELD

The present invention relates generally to ships' steering gear mechanisms, and more particularly to improvements in the actuating mechanisms for Rapson-Slide slide type of steering apparatus.

BACKGROUND

Methods and apparatus for actuating ships' rudders have a long history of development and have over the years produced a wide range of mechanisms directed to the task of controllably setting ships' rudder angles. One particularly successful approach is found in the family of Rapson-Slide mechanisms that basically convert rectilinear port/starboard motion produced by heavy thruster devices into arcuate movement directly coupled to the ship's rudder post by crosshead pin/slider/fork components. Due to the substantive forces involved in setting and maintaining rudder angles, especially as ship size has increased, and further due to the criticality of this ship's component to life and commerce, the evolution of steering mechanisms has been conservatively paced with primary emphasis placed on safe and reliable approaches. Thus, the Rapson-Slide mechanism has come into widespread usage because of its simple mechanical arrangement that lends itself readily to strong and reliable component fabrication and long service life.

The availability of such a proven mechanism coupled with the advances in hydraulic control systems of all types for powering the driving elements has led to a plateau in the evolution of ships' steering mechanisms. Descriptions of typical prior art approaches may be found in a number of U.S. patents. Illustrative teachings of pressurized liquid-operated ships' steering gear systems, including the use of a wide range of Rapson-Slide type of mechanisms, are found in U.S. Pat. Nos. 4,365,573 to Jamieson, 4,209,986 to Cunningham, and 4,408,555 to Aung. An even earlier teaching of a somewhat related simplified ship's steering gear mechanism is found in U.S. Pat. No. 2,748,613 to Guay. The most recent three of these patents show the use of four hydraulic cylinders arranged as two pairs in parallel, with each pair in opposition to one another to actuate compound crosshead assemblies, which have found widespread acceptability in recent years. The 1980 patent to Cunningham provides a fairly detailed description of the closed loop hydraulic control system used to actuate the apparatus, while all three disclosures stress the reliability and redundancy of their associated mechanical and hydraulic systems. The early (1956) patent to Guay discloses the use of a single pair of double acting fluid cylinders for driving a lever and slide mechanism, the two cylinders interconnected by a stationary guide member on one side of its slider block.

Present day steering gear systems have well addressed the requirements of safety, reliability, and long service life. The question of mechanical efficiency has not, however, received anywhere near as much active attention. The improvements embodied in the present invention admirably address the efficiency issues inherent in the Rapson-Slide mechanisms and provide significant benefits in this regard while retaining all of the desirable attributes of the basic device.

OBJECTS OF THE INVENTION

It is therefore a primary object of the present invention to provide an improved ship's steering gear mechanism, and one that will retain the proven benefits of the well-known prior art devices while overcoming their disadvantages.

A further object of the present invention is to provide a ship's steering mechanism that may be implemented using hydraulic cylinders sized to provide the forces needed for safe and effective steering, but which are relieved from the burdensome size requirements that result from the need to absorb potentially damaging dynamic forces developed during normal usage.

A still further object of the present invention is to provide a steering mechanism that includes specially sized and shaped slider elements to minimize sliding friction/stiction, reduce friction losses due to gravity, reduce wear, and improve small rudder angle controllability. Each of these benefits reduces system operating losses, thereby further improving operating efficiency.

A yet further object of the present invention is to provide an improved mounting arrangement for the hydraulic cylinders employed to drive the interconnecting mechanisms, wherein initial installation misalignments, as well as misalignments occurring during operational usage, are compensated for without sacrificing system strength, rigidity, or operating life.

In accordance with preferred and alternate embodiments, an improved Rapson-Slide steering mechanism is provided having one or more port/starboard-oriented travelling channels formed by one or more pairs of transverse beam members in which either sliding or rolling slider elements are constrained to travel. By so doing, harmful longitudinal forces inherently developed within the linear-to-rotary motion converting mechanism are absorbed by the beams and thus are prevented from reaching the end seal portions of the hydraulic cylinders. Sliding friction within the traveling channels is also minimized. One or more pairs of oppositely disposed hydraulic cylinders are interconnected pair by pair via their associated piston rods to form a continuous line of action for each pair, the combination oriented port/starboard or transversely to the ship's fore/aft or longitudinal axis. The inboard ends of the cylinders carrying the end seal members through which the common rod moves are pivotally mounted to the pair of transverse beams by trunion bearings that permit limited cylinder rotation in a vertical plane—thereby readily accommodating small static and dynamic misalignments.

BRIEF DESCRIPTION OF THE DRAWINGS

Additional objects and advantages of the invention 5 will become apparent to those skilled in the art as the description proceeds with reference to the accompanying drawings wherein.

BEST MODE FOR CARRYING OUT THE INVENTION

Figure 1:
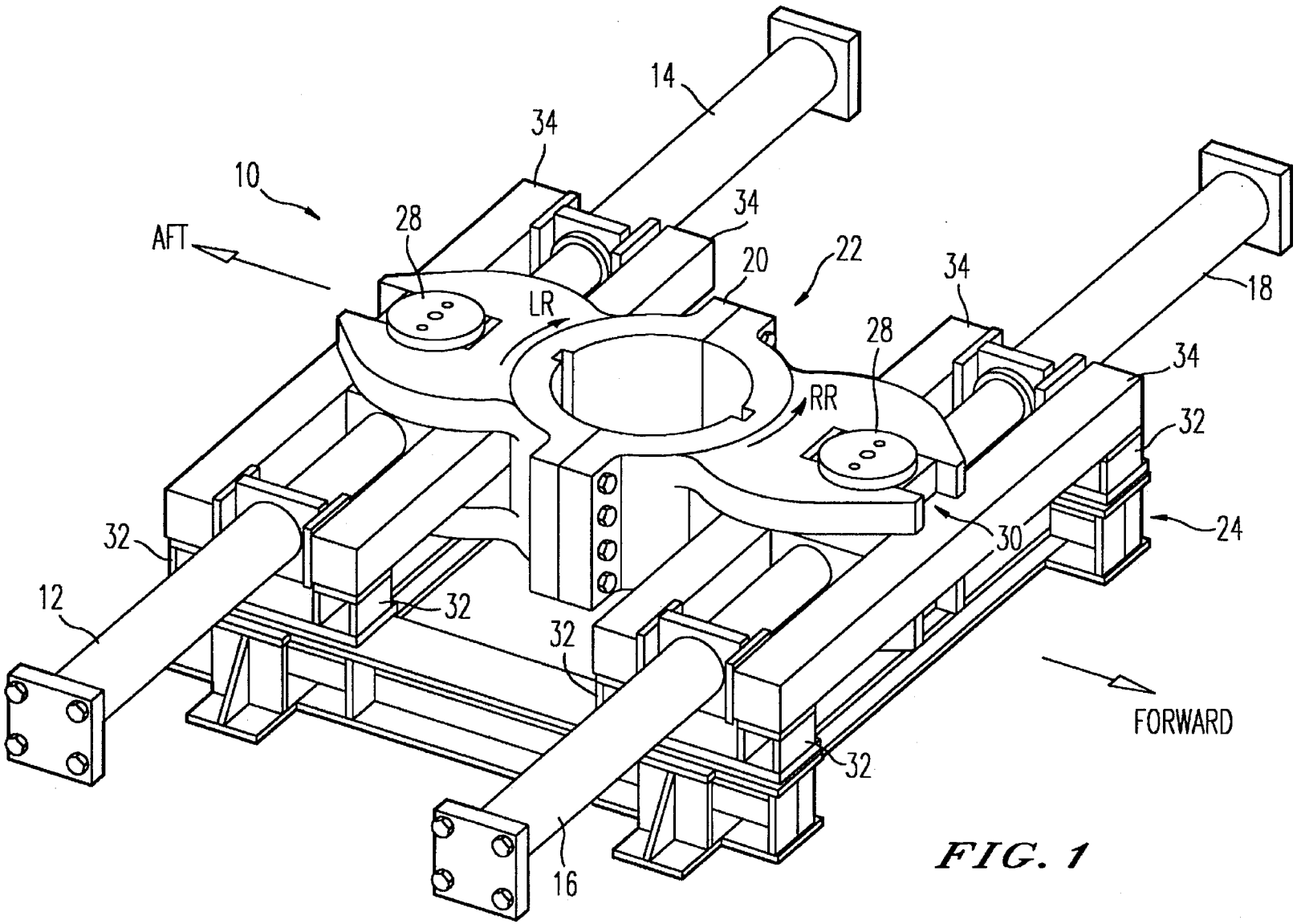
FIG. 1 is a perspective view of an overall ship's steering gear mechanism embodying the improved features according to the present invention.

Referring now to FIG. 1, there is shown a perspective view of a ship's steering gear mechanism embodying the improved features according to the present invention. An overall steering mechanism 10 is shown as including two pairs of opposed hydraulic cylinders 12, 14, 16, and 18 that coact to impart steering force and rotary motion to a rudder stock (not shown) fitted into a hub portion 20 of a dual crosshead assembly 22. The major elements of the steering mechanism 10 may be mounted on a heavy machine base 24 having a primary longitudinal axis oriented fore/aft as shown by a pair of correspondingly 5 labeled arrows. When so oriented, the steering mechanism 10 will execute left rudder "LR" and right rudder "RR" actions in the directions indicated by the two arcuate arrows on the crosshead assembly 22 in the conventional manner according to well-known basic Rapson-Slide operation by virtue of the action of crosshead assembly 22 being acted on by one or more crosshead pins 26 (not shown in FIG. 1) via a slider block 30. Each crosshead pin may be capped by a washer end clamp 28. It has become customary to employ four single acting cylinders arranged in pairs of two operating in opposition to power the steering crosshead using various types of closed loop hydraulic control systems. The use of two pairs of cylinders operating in parallel increases steering system reliability, and the cylinders are typically sized conservatively to ensure sufficient steering power and wear strength for all expected underway conditions. For similar reliability considerations, it has also become conventional to arrange the crossheads as dual-jawed elements to provide multiple sliding/rolling action surfaces with a like plurality of crosshead pins. In the embodiment shown, four such surfaces are contemplated. The interested reader is referred to the descriptions contained in the aforementioned U.S. Pat. Nos. 4,365,573 to Jamieson and 4,208,985 to Cunningham for details of typical ship's steering gear systems, also including information on their associated hydraulic control systems. The hydraulic control loops, as well as possible alternate types of driver or thruster devices and their controllers, form no part of the present invention. In a preferred embodiment of the steering mechanism 10, the primary active elements in the form of hydraulic cylinders 12–16 are mounted on the base 24 via an array of beam support brackets 32. In an especially preferred embodiment, an array of four transverse beams 34 provides significant benefit to the steering mechanism 10 by serving as hydraulic cylinder stress and wear-reducing elements, and further by decreasing the stiction/friction forces in selected alternate embodiments.

Figure 2A:
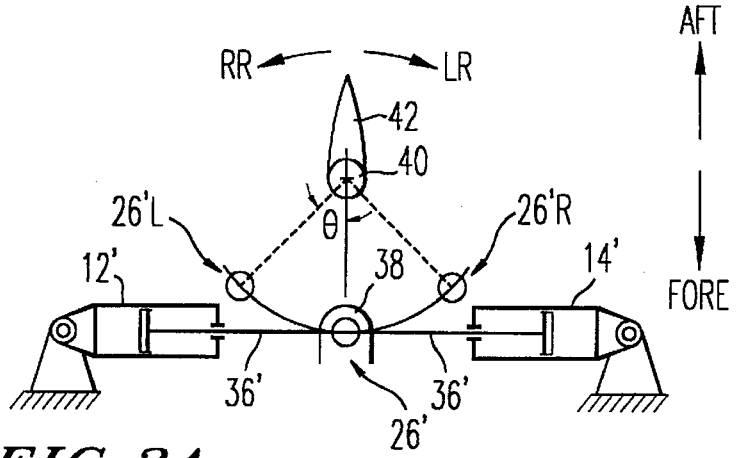
FIG. 2A PRIOR ART
FIG. 2A is a simplified schematic diagram of a basic ship's steering mechanism actuated by a pair of hydraulic cylinders pivoted at their distal or outboard ends.

In order to appreciate the benefits that derive from the modifications suggested to the basic Rapson-Slide mechanism, and its usual variants, it is useful to first describe some basic forces inherently involved in them, and then teach how the present invention significantly mitigates the most harmful and potentially destructive of these forces. Referring now to FIG. 2A, there is shown a simplified free-body diagram in highly schematic form of a basic steering mechanism actuated by two hydraulic cylinders 12' and 14', which actuate a pair of inter-connected piston rods 36' having at their pivoted junction point a slide pin/slide block 26'. A Rapson-Slide-type fork 38 is pivoted about the rotational axis 40 of a rudder stock, all of which converts the left/ right translational movement of pistons within the cylinders 12' and 14' into the desired rotation of a ship's rudder 42. The two cylinders are independently pivoted at their outboard ends about a vertical axis to accommodate the motion needed for full right and left rudder movement when slide pin/block 26' moves to the locations 26'R and 26'L, respectively. It can be shown analytically that the torque generated by the cylinders (alternately referred to herein as drivers or thrusters) in this arrangement is proportional to the cosine of the rudder angle θ. Therefore, the driver-generated torque decreases, while the rudder torque demand increases with the increase of the angle θ. Hence, minimum torque is generated at maximum demand—an undesirable but inherent result of this basic type of steering mechanism.

Figure 2B:
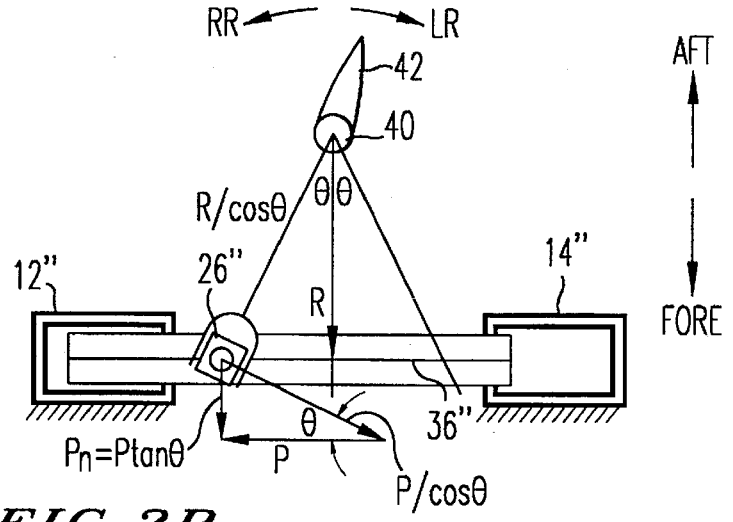
FIG. 2B PRIOR ART
FIG. 2B is a simplified schematic diagram of a conventional Rapson-Slide steering mechanism.

The conventional Rapson-Slide mechanism shown in simplified form in FIG. 2B addresses the design inefficiencies of the basic embodiment of FIG. 2A and therefore has found widespread usage. However, this approach also has its shortcomings that previously have been compensated for by brute force means. Once the disadvantages of the conventional Rapson-Slide arrangement are recognized and quantified, some elegantly simple and novel solutions may be implemented. That is exactly what the present invention provides. In a simplified two-cylinder version, as before, two hydraulic cylinders 12" and 14" actuate a common rod 36" having a slide pin/block 26" at its midpoint. Also as before, a fork 38 pivoted about the rudder stock axis 40 imparts the desired rotary motion to the rudder 42. The cylinders 12" and 14' are fixedly mounted to the ship's hull and the rudder stock axis 40 is journaled in bearings (not shown) also fixedly mounted to the hull. The slide pin/block 26" and fork 38 therefore become the location where the two major ship's structures interact, which gives rise to an undesirable phenomena that the present invention addresses. In this arrangement as described thus far, it can be shown analytically that the maximum torque is generated when needed—i.e., at maximum right and left rudder angles. However, this arrangement also generates a large force component $P_n$ proportional to Ptan θ, where P is the component as shown in the vector right triangle having hypotenuse P/cos θ and arm Pn. R is the perpendicular distance from the rudder stock axis 40 to the common rod 36". This force $P_n$ rises in the fore/aft direction as indicated by the line vector diagram. The $P_n$ component can occur in either direction, forward or aft, depending on dynamic conditions of the various in-use forces, and hence is more properly labeled as $\pm P_n$. $P_n$ may be of near destructive magnitude under certain operating conditions, and also induces substantial friction/stiction losses in the fork/slide interface under almost all operating conditions. In use, certain friction reducing schemes are sometimes employed, but the primary disadvantage is that the hydraulic rams themselves must be strong enough to resist the $\pm P_n$ forces. This requirement has been satisfied in prior art systems by employing hydraulic cylinders sized well beyond that required to generate the needed rudder operating torques, especially to protect the ram seal areas. Whereas the piston rods are commercially surface-hardened for high-wear resistance, the heavy rams are medium carbon normalized forgings that offer a low-wear resistance, and they can be improved only at very high manufacturing costs.

Figure 5:
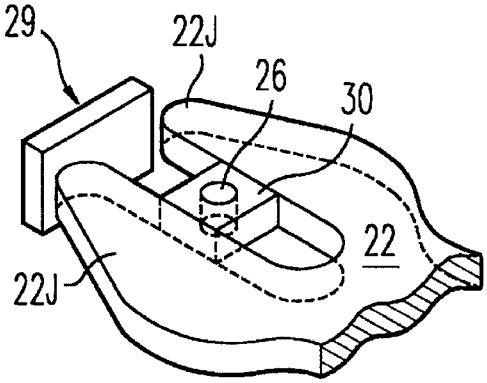
FIG. 5 is a fragmented perspective view, partially in phantom, showing details of a typical crosshead slide pin/block arrangement.

The slider pin/block 26" (and related equivalents described hereinbelow) is typically arranged in the form of a slider block 30 rotatably carried by the crosshead pin 26 (or 26', 26", or 26*), as shown in the simplified partial phantom drawing of FIG. 5. The slider block 30 rides snugly between the jaws 22J of the crosshead assembly 22. For selected alternate end uses, a crosshead end tie plate 29 may be affixed to the outer ends of the jaws 22J and an end washer clamp 30 (as shown in FIG. 1) may be employed.

Figure 2C:
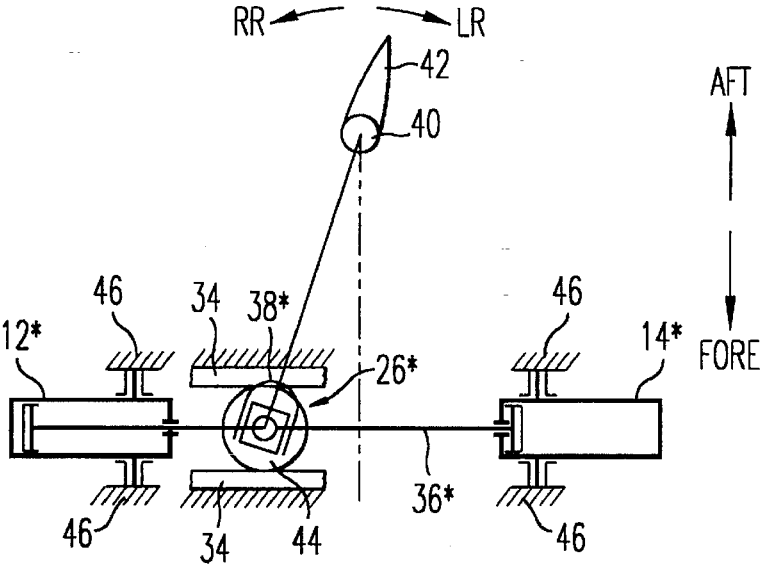
FIG. 2C is a simplified schematic diagram of an improved Rapson-Slide steering mechanism according to the present invention.

Turning now to FIG. 2C, there is shown a modified Rapson-Slide steering mechanism in simplified schematic form, detailing the improvements embodied in the present invention. As before, a two-hydraulic cylinder arrangement is shown, having cylinders 12*, and 14*, interconnected by a pair of piston rods connected to form a continuous line of action shown as rod 36*, which includes a slide pin/block 26* at its midpoint. The pin portion of 26* is carried by a travelling slider wheel 44, which is constrained to move in a port/starboard-aligned travelling channel formed by a pair of transverse beams 34 (depicted in connection with FIG. 1) which are rigidly fixed to the ship's hull via the machine base 24 as previously described. The fork 38, shows conversion of starboard translation of the slide pin/block 26* into left rudder rotation of rudder 42 about its stock axis 40. The cylinders 12, and 14, are mounted via trunion pin/bearing assemblies 46, which rigidly maintain their transverse spacing, while allowing for some rotational movement in a vertical plane about the fore/aft trunion axes.

The thus modified Rapson-Slide mechanism therefore maintains the advantages of generating larger torque when demand is larger—at larger rudder angles—but additionally provides the following advantages. Firstly, the high $\pm P_n$ forces are completely buffered from being transmitted to the hydraulic rams by use of the transverse beams 34. As is evident, the $\pm P_n$ forces are constrained by the slider wheel 44 acting on the inner walls of the beams 34, allowing the use of commercially available hydraulic cylinders sized to provide the required rudder torque, but relieved of the requirement to absorb large and potentially destructive piston ram/ cylinder casing loads. Additionally, since the beams are fixed, the travelling slider may be much lighter than the travelling rams, and the resulting frictional loss due to gravity is much smaller. Other ancillary benefits are—to the extent that suitably sized, off-the-shelf hydraulic cylinders may be used—lower initial costs, higher unit reliability, and greatly facilitated worldwide access to and stocking of spare parts.

Secondly, use of the slider wheel 44 substantially decreases the stiction/friction losses by reacting to the $\pm P_n$ and other forces with a rolling friction instead of a sliding friction. The rolling friction improves the controllability of the steering mechanism, and in addition will reduce the vibration resulting from stiction/friction that is normally encountered when small steering corrections are made. Additionally, the trunion-mounted commercial hydraulic cylinders with casters or rollers mounted at the junction of the piston rods will minimize any loading due to the possible small misalignments during initial installation and others that may develop during its operational life.

Figure 3:
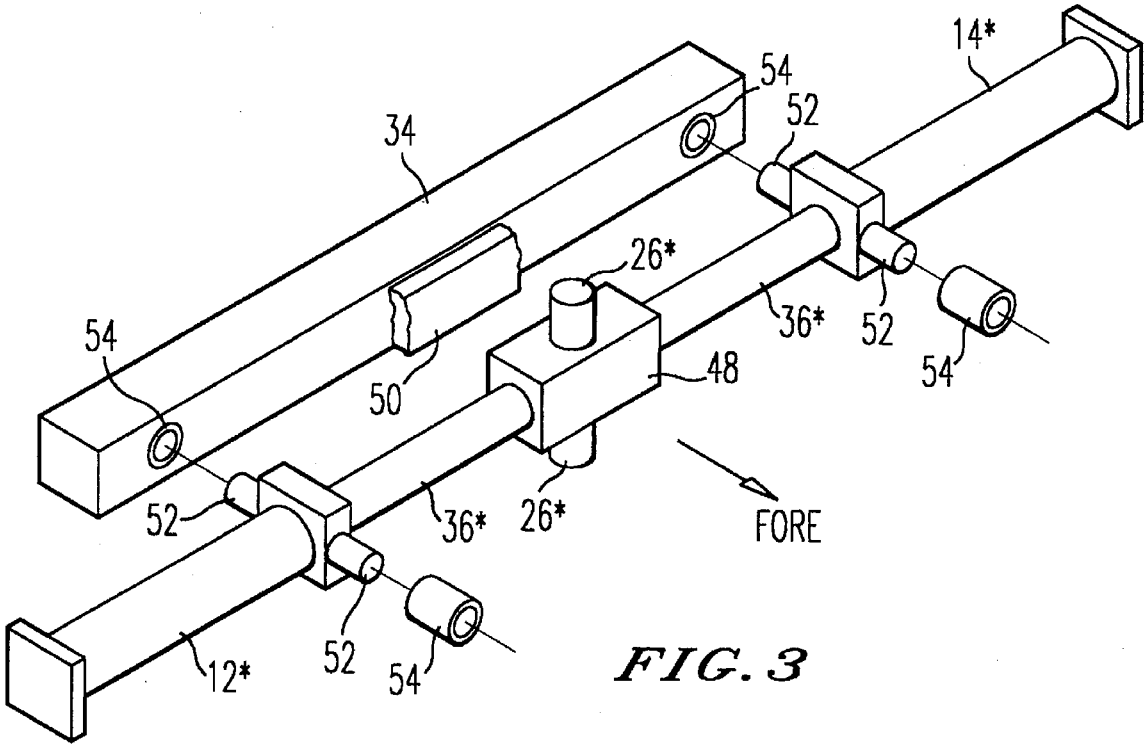
FIG. 3 is a simplified pictorial representation of selected portions of the improved Rapson-Slide steering mechanism of FIG. 2C, from the same perspective as the overall steering gear shown in FIG. 1.

Referring now to FIG. 3, there is shown a pictorial representation of the modified Rapson-Slide steering mechanism of FIG. 2C giving selected structural elements in more detail. For clarity of exposition, selected other elements of the overall mechanism have been omitted, the component designations of FIGS. 1 and 2C have been retained where appropriate, and the system perspective of FIG. 1 has been retained. In a first preferred alternate embodiment, a steel slider block 48 is rigidly fixed near the midpoint of the pair of piston rods connected to form rod 36*, and carries upper and lower crosshead pins 26* on its top and bottom faces. The slider block 48 functions similarly to the previously described slider wheel 44 in that it transmits any $\pm P_n$ forces developed by the pin 26* /fork 38* interaction to the transverse beams 34. A bronze slider wear plate 50 positioned between the beams 34 and the block 48 provides decreased static and sliding friction between the two surfaces. The aft beam and plate are shown; a corresponding forward beam and other elements (not shown) are, of course, also used. Each hydraulic cylinder includes a pair of horizontal trunion pins 52 at its inboard end, which pins mate with a like number of trunion sleeve bearings 54 pressed into blind holes in the beams 34. For certain shipboard applications, the two-cylinder arrangement of FIG. 3 is perfectly adequate and provides the full benefits described above in a very cost-effective manner. In other shipboard applications, the four-cylinder arrangement of FIG. 1 is called for. Other variants of this improved mechanism are also contemplated, all of which relieve the requirements of using heavier duty or specially designed hydraulic cylinders, drivers, or thrusters, in addition to providing reduced stiction/friction at the high force interfaces, and further improving small rudder angle controllability.

Figure 4:
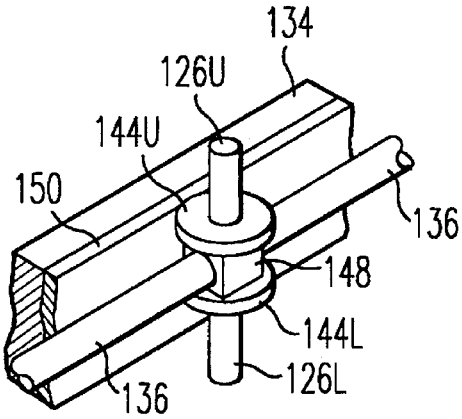
FIG. 4 is a fragmented perspective view of an illustrative roller arrangement used in an alternate preferred embodiment.

In an alternate preferred embodiment, the travelling slider block 48 of FIG. 3 is replaced with various types of travelling roller assemblies, one of which is suggested in connection with the description of FIG. 2C. An illustrative roller arrangement for use with the steering mechanism 10 is provided in the fragmented perspective drawing of FIG. 4. While other equivalent rolling arrangements are contemplated, the main objective of all roller alternates is to decrease the substantial amount of stiction/friction losses incurred when travelling in the snug fit transverse travelling channel formed between the transverse beams when acting to absorb the $\pm P_n$ forces described above. As shown in FIG. 4, a pair of piston rods connected to form a common rod 136 interconnecting a pair of drivers, thrusters, or cylinders (not shown) includes a smaller block-like hub 148 fixedly positioned near its midpoint. Upper and lower crosshead pins 126U and 126L fixed to the upper and lower faces, respectively, of the hub 148 rotatably carry upper and lower slider wheels 144U and 144L. As before, the slider wheels transmit the $\pm P_n$ forces to the transverse beams 134 (only the aft being shown) via an optional bronze slider wear plate 150. In use, this and other similar roller embodiments function in a manner analogous to the slider block embodiment of FIG. 3 but give the benefits of rolling friction over that of sliding friction. This is not an insignificant consideration when the magnitude of the forces involved in large ships' steering mechanisms are considered.

Although the invention has been described in terms of selected preferred and alternate embodiments, the invention should not be deemed limited thereto, since other embodiments and modifications will readily occur to one skilled in the art. Similarly, the benefits of the disclosed improvements to Rapson-Slide mechanisms are equally contemplated for use in other waterborne vessels of all types, including boats, barges, floating structures, and the like. It is therefore to be understood that the appended claims are intended to cover all such modifications and end uses as fall within the true spirit and scope of the invention.

We claim:

1. An improved ship's steering mechanism of the type having at least two oppositely disposed hydraulic cylinders interconnected by at least two transversely disposed piston rods connected to form a common operating rod having a continuous line of action, for converting complementary linear cylinder motion via a crosshead fork/arm member into rotary motion of a vertically pivoted rudder stock, said mechanism comprising:

(a) a slider element fixed at a central position along said common rod, said slider carrying at least one vertical crosshead pin for transmitting transverse linear motion to said crosshead fork/arm member;

(b) a pair of transverse beams forming a travel channel extending parallel to a direction of said continuous line of action for said slider element with said slider element contacting at least one of said transverse beams during a steering operation and being supported by said at least one of said beams; and (c) whereby longitudinal components of dynamic forces within said steering mechanism in a horizontal plane are absorbed by said beams and thus are prevented from being transmitted back into said hydraulic cylinders.

2. The steering mechanism of claim 1 wherein said slider element is a slider block having substantially vertical exterior side faces for slidably traveling within substantially vertical interior side faces of said transverse beams.

3. An improved ship's steering mechanism of the type having at least two oppositely disposed hydraulic cylinders interconnected by at least two transversely disposed piston rods connected to form a common operating rod having a continuous line of action, for converting complementary linear cylinder motion via a crosshead fork/arm member into rotary motion of a vertically pivoted rudder stock, said mechanism comprising:

(a) a slider element fixed at a central position along said common rod, said slider carrying at least one vertical crosshead pin for transmitting transverse linear motion to said crosshead fork/arm member;

(b) a pair of transverse beams forming a travel channel in a horizontal plane for said slider element;

(c) whereby longitudinal components of dynamic forces within said steering mechanism in a horizontal plane are absorbed by said beams and thus are prevented from being transmitted back into said hydraulic cylinders;

wherein said slider element is a slider block having substantially vertical exterior side faces for slidably travelling within substantially vertical interior side faces of said transverse beams; and wherein each of said at least two hydraulic cylinders is pivotally mounted at an inboard end by a pair of longitudinally oriented trunion bearings for limited rotation in a vertical plane.

4. The steering mechanism of claim 3 wherein said pairs of trunion bearings are aligned along horizontal axes and are adapted for mounting within said transverse beams.

5. The steering mechanism of claim 2 wherein said transverse beam interior faces each include a slider wear plate disposed thereon.

6. The steering mechanism of claim 2 wherein an upper and lower vertical crosshead pin is carried by said slider block and said crosshead fork/arm member includes cooperating upper and lower jaw members for engaging said pins.

7. The steering mechanism of claim 6 wherein said mechanism includes two pairs of oppositely disposed hydraulic cylinders, each pair interconnected by a transversely disposed common operating rod and separately actuable, for operation in parallel with a four-jawed crosshead fork/arm member.

8. The steering mechanism of claim 1 wherein said slider element is a roller pivoted for vertical rotation, for rotatably travelling with reduced sliding friction within said travel channel.

9. An improved ship's steering mechanism of the type having at least two oppositely disposed hydraulic cylinders interconnected by at least two transversely disposed piston rods connected to form a common operating rod having a continuous line of action, for converting complementary linear cylinder motion via a crosshead fork/arm member into rotary motion of a vertically pivoted rudder stock, said mechanism comprising:

(a) a slider element fixed at a central position along said common rod, said slider carrying at least one vertical crosshead pin for transmitting transverse linear motion to said crosshead fork/arm member;

(b) a pair of transverse beams forming a travel channel in a horizontal plane for said slider element;

(c) whereby longitudinal components of dynamic forces within said steering mechanism in a horizontal plane are absorbed by said beams and thus are prevented from being transmitted back into said hydraulic cylinders; wherein said slider element is a roller pivoted for rotation, for rotatably travelling with reduced sliding friction within said travel channel; and wherein each of said at least two hydraulic cylinders is pivotally mounted at an inboard end by a pair of longitudinally oriented trunion bearings for limited rotation in a vertical plane.

10. The steering mechanism of claim 9 wherein said pairs of trunion bearings are aligned along horizontal axes and are adapted for mounting within said transverse beams.

11. The steering mechanism of claim 8 wherein said travel channel includes a slider wear plate which said roller contacts during a steering operation.

12. The steering mechanism of claim 8 wherein an upper and lower crosshead pin is carried by said roller and said crosshead fork/arm member includes cooperating upper and lower jaw members for engaging said pins.

13. The steering mechanism of claim 8 wherein said mechanism includes two pairs of oppositely disposed hydraulic cylinders, each pair interconnected by at least two transversely disposed piston rods connected to form a common operating rod having a continuous line of action and separately actuable, for operation in parallel with a multiple-jawed crosshead fork/arm member.

14. The steering mechanism of claim 13 wherein each of said upper and lower crosshead pins is operatively connected to its corresponding upper and lower jaw members by means of a jaw slider block pivoted about said pin and moveable within parallel interior faces of said jaws.

15. A method of minimizing the harmful effects of longitudinal horizontal forces developed in a ship's steering mechanism of the Rapson-Slide type from being reflected back into the hydraulic rams of a pair of transversely disposed hydraulic cylinders used for rotating the ship's rudder, and for minimizing friction losses;

said mechanism having at least one pair of hydraulic cylinders interconnected by a common rod having a slider element fixed near a central position along said rod, said rod complementary actuable by each of said cylinders through an end seal portion to provide linear cylinder motion in a direction, said slider element carrying at least one vertical crosshead pin for converting the linear cylinder motion into rotary motion of a ship's rudder stock;

said method comprising: providing a pair of transverse beams to form a travelling channel for said slider element with said channel extending parallel to said direction and with said slider contacting at least one of said pair of transverse beams during a steering operation, such that said channel absorbs said longitudinal horizontal forces and prevents their harmful reflection back into the hydraulic cylinder's end seal portion.

16. The method of claim 15, including the further step of providing a roller slider element pivoted for vertical rotation about an axis fixed near said central position, for rotatably travelling within said channel with reduced friction.

17. The method of claim 15, including the further step of providing a pair of longitudinally oriented trunion bearings at inboard ends of each of said at least two hydraulic cylinders to relieve the static and dynamic stresses developed in said mechanism by allowing limited cylinder rotation in a vertical plane.

18. A method of minimizing the harmful effects of longitudinal horizontal forces developed in a ship's steering mechanism of the Rapson-Slide type from being reflected back into the hydraulic rams of a pair of transversely disposed hydraulic cylinders used for rotating the ship's rudder, and for minimizing friction losses;

said mechanism having at least one pair of hydraulic cylinders interconnected by a common rod having a slider element fixed near a central position along said rod, said rod complementary actuable by each of said cylinders through an end seal portion, said slider element carrying at least one vertical crosshead pin for converting linear cylinder motion into rotary motion of a ship's rudder stock;

said method comprising:

providing a pair of transverse beams to form a travelling channel for said slider element, said channel serving to absorb said longitudinal horizontal forces thereby preventing their harmful reflection back into the hydraulic cylinder's end seal portion; and providing a pair of longitudinally oriented trunion bearings at inboard ends of each of said at least two hydraulic cylinders to relieve the static and dynamic stresses developed in said mechanism by allowing limited cylinder rotation in a vertical plane; and aligning said trunion bearings in a horizontal plane for mounting within said transverse beam for permitting limited cylinder rotation for aligning compensation while rigidly maintaining the cylinder's transverse separation.

19. The method of claim 15, including the further step of providing said travelling channel with slider wear plates for minimizing frictional losses between said travelling channel and said slider element.

20. In a steering mechanism for waterborne vessels, of the Rapson-Slide type having at least one pair of hydraulic cylinders interconnected by their piston rods to form a common rod having a continuous line of action for carrying out complementary intermittent reciprocating movement, a slider element fixedly positioned near a central portion of the rod, at least one vertical crosshead pin fixed to said slider element for transmitting said reciprocating motion to a crosshead fork member pivoted about a vertical axis to convert said reciprocating motion to intermittent rotary motion of a rudder stock, the improvement comprising:

(a) adding a pair of transverse horizontal beams to form a travelling channel extending parallel to said continuous line of action, and wherein said slider element is disposed in said channel and contacts at least one of said pair of transverse beams to be supported by said at least one of said transverse beams during a steering operation; and (b) whereby longitudinal horizontal forces induced in said rod/slider/pin elements by said fork element are absorbed by said transverse beams and prevented from being transmitted to said hydraulic cylinders.

21. A steering mechanism comprising:

a pair of hydraulic cylinders connected by a rod element for providing linear movement in a direction parallel to said rod element;

a slider element disposed on said rod element;

a steering member;

means for converting said linear movement into rotary movement to rotate said steering member, said means for converting being coupled to said slider element and being coupled to said steering member; and a channel extending in said direction parallel to said rod element, wherein said slider element is disposed is said channel and contacts an inner surface of said channel during a steering operation such that said channel absorbs forces transverse to said direction parallel to said rod element.

22. A steering mechanism as recited in claim 21, wherein said slider element includes roller means such that said slider element is in rolling contact with the inner surface of said channel.

23. A steering mechanism as recited in claim 21, wherein said means for converting includes an upper fork/arm member and a lower fork/arm member, and wherein said channel is disposed between said upper fork/arm member and said lower fork/arm member.

* * * * *